US006162107A

United States Patent [19]

Woo

[11] Patent Number: 6,162,107

[45] Date of Patent: Dec. 19, 2000

[54] PROCESS OF FABRICATING FRONT SUBSTRATE IN PLASMA DISPLAY PANEL

[75] Inventor: Sung Ho Woo, Daeku-shi, Rep. of Korea

[73] Assignee: LG Electronics, Inc., Seoul, Rep. of Korea

[21] Appl. No.: 09/475,117

[22] Filed: Dec. 30, 1999

[30] Foreign Application Priority Data

Dec. 31, 1998 [KR] Rep. of Korea ..... 98-63397

[51] Int. Cl.[7] ..... H01J 9/00

[52] U.S. Cl. ..... 445/24

[58] Field of Search ..... 445/24; 313/584–587

[56] References Cited

U.S. PATENT DOCUMENTS

| | | | |
|---|---|---|---|
| 5,159,278 | 10/1992 | Koiwa et al. | 313/584 |
| 5,731,858 | 3/1998 | Hisatake et al. | 349/112 |
| 6,084,705 | 7/2000 | Zieba et al. | 359/350 |

*Primary Examiner*—Kenneth J. Ramsey
*Attorney, Agent, or Firm*—Birch, Stewart, Kolasch & Birch, LLP

[57] ABSTRACT

A process of fabricating a front substrate in a color display panel that is adapted to form transparent electrodes and transparent conductive films in a plasma display panel. In the process, a liquid-state transparent conductive material is entirely formed on both the front side and the rear side of the substrate. Next, any one of the transparent conductive material films formed on the front side and rear side thereof is patterned.

8 Claims, 4 Drawing Sheets

PROCESS OF FABRICATING FRONT SUBSTRATE IN PLASMA DISPLAY PANEL

BACKGROUND OF THE INVENTION

1. Field of the Invention

This invention relates to a process of fabricating a color display panel, and more particularly to a process of fabricating a color display panel that is adapted to form transparent electrodes and transparent conductive films in a plasma display panel.

2. Description of the Related Art

Generally, a plasma display panel(PDP) radiates a fluorescent material (or phosphor) by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system.

The PDP of AC driving system is expected to be highlighted into a future display device because it has advantages in the low voltage drive and a prolonged life in comparison to the PDP of DC driving system. Also, the PDP of AC driving system allows an alternating voltage signal to be applied between electrodes having a dielectric layer therebetween to generate a discharge every half-period of the signal, thereby displaying a picture. Since such an AC-type PDP uses a dielectric material, the surface of the dielectric material is charged with electricity. The AC-type PDP allows a memory effect to be produced by a wall charge accumulated to the dielectric material due to the discharge.

Referring to FIG. 1, the AC-type PDP includes a front substrate 1 provided with a sustaining electrode pair 10A and 10B, and a rear substrate 2 provided with an address electrode 4. The front substrate 1 and the rear substrate 2 are spaced in parallel with having a barrier rib 3 therebetween. A mixture gas such as Ne–Xe or He–Xe, etc. is injected into a discharge space defined by the front substrate 1 and the rear substrate 2 and the barrier rib 3. The sustaining electrodes 10A and 10B consist of transparent electrodes 6A and 6B and metal electrodes 7A and 7B. The transparent electrodes 6A and 6B are usually made from Indium-Tin-Oxide (ITO) and has an electrode width of about 300 $\mu$m. Usually, the metal electrodes 7A and 7B take a three-layer structure of Cr—Cu—Cr and have an electrode width of about 50 to 100 $\mu$m. These metal electrodes 7A and 7B play a role to decrease a resistance of the transparent electrode 6 with a high resistance value to thereby reduce a voltage drop. Such sustaining electrodes 10 make a pair by two within a single plasma discharge channel. Any one of a pair of sustaining electrode 10 is used as a scanning/sustaining electrode that responds to a scanning pulse applied in an address interval to cause an opposite discharge along with the address electrode 4 while responding to a sustaining pulse applied in a sustaining interval to cause a surface discharge with the adjacent sustaining electrodes 10. A sustaining electrode 10 adjacent to the sustaining electrode 10 used as the scanning/sustaining electrode is used as a common sustaining electrode to which a sustaining pulse is applied commonly. A distance a between the sustaining electrodes 10 making a pair is set to be approximately 100 $\mu$m. On the front substrate 1 provided with the sustaining electrodes 10, a dielectric layer 8 and a protective layer 9 are disposed. The dielectric layer 8 is responsible for limiting a plasma discharge current as well as accumulating a wall charge during the discharge. The protective film 9 prevents a damage of the dielectric layer 8 caused by a sputtering generated during the plasma discharge and improves an emission efficiency of secondary electrons. This protective film is usually made from MgO. Barrier ribs 3 for dividing the discharge space is extended perpendicularly at the rear substrate 2, and the address electrode 4 is formed between the barrier ribs 3. On the surfaces of the barrier ribs 3 and the address electrode 4, a fluorescent layer 5 excited by a vacuum ultraviolet lay to generate a visible light is provided.

Further, the AC-type PDP includes a color filter 12 provided at the front surface of the front substrate 1. The color filter 12 is added with a red, green or blue pigment to transmit only a specified wavelength of light, thereby improving the color purity. The color filter 12 may include a function of shielding an electromagnetic wave. To this end, the color filter 12 is mixed with a conductive mash, and is grown with a transparent conductive film using a vacuum deposition technique. The transparent conductive film is usually made from ITO and is entirely deposited on the front substrate 1. The color filter 12 or the transparent conductive film having a function of shielding an electromagnetic wave is connected to a ground voltage source GND.

As shown in FIG. 3, the PDP 20 has mxn discharge pixel cells 11 arranged in a matrix pattern. At each of the discharge pixel cells 11, scanning/sustaining electrode lines Y1 to Ym, common sustaining electrode lines Z, and address electrode lines X1 to Xn are crossed with respect to each other. The scanning/sustaining electrode lines Y1 to Ym and the common sustaining electrode lines Z consist of the sustaining electrode 10A and 10B making a pair. The address electrode lines X1 to Xn consist of the address electrode 4.

However, the conventional PDP has a difficulty in that the conductive mash must be uniformly mixed when the conductive mash is added to the color filter 12, and has a problem in that a fabrication cost rises due to the conductive mash that is a separate additive. Also, it has problems in that a fabrication cost rises because the transparent conductive material formed on the conventional PDP is deposited using the vacuum sputtering technique, and that a resistance is increased because the transparent conductive film deposited at a low temperature is oxidized at the time of a firing of a dielectric layer requiring a high-temperature heat treatment. Moreover, it has a problem in that a bubble is left in the transparent conductive film formed in the post process due to a bubble generated upon oxidation of the transparent conductive film.

SUMMARY OF THE INVENTION

Accordingly, it is an object of the present invention to provide a process of fabricating a front substrate in a color display panel that is adapted to form transparent electrodes and transparent conductive films in a plasma display panel.

In order to achieve these and other objects of the invention, a process of fabricating a front substrate in a color display panel according to one aspect of the present invention includes the steps of entirely forming a liquid-state transparent conductive material on both the front side and the rear side of the front substrate; and patterning any one of the transparent conductive material films formed on the front side and the rear side of the front substrate.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
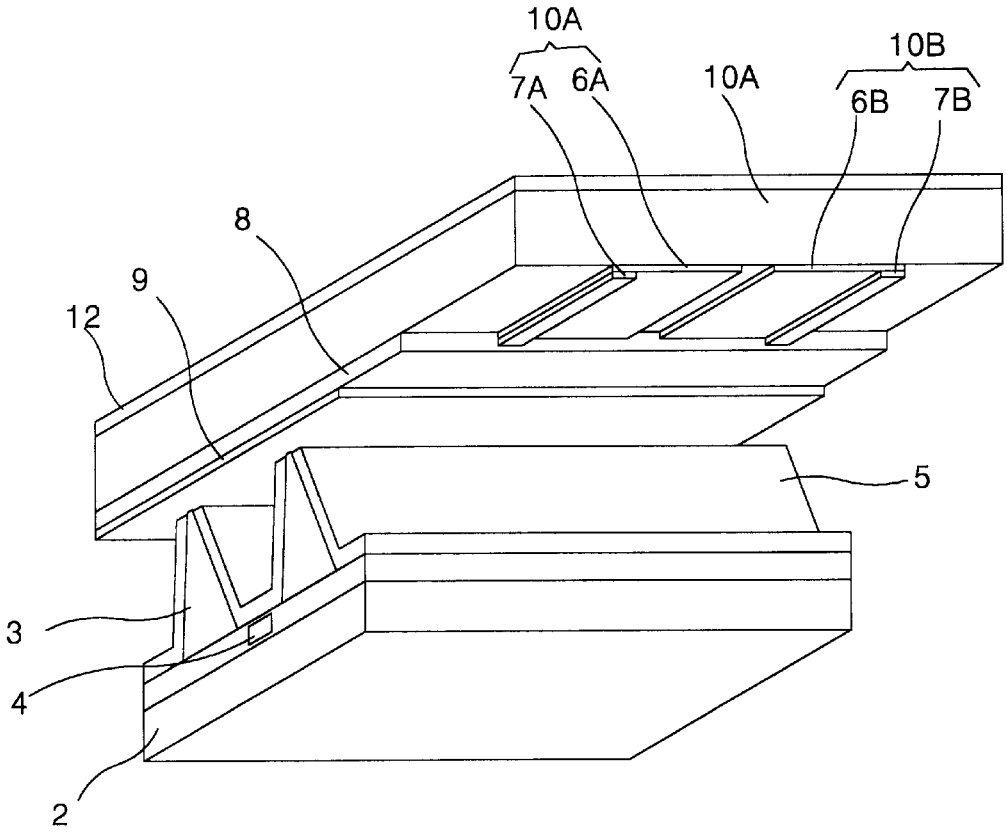
FIG.1 RELATED ART
FIG. 1 is a schematic perspective view showing the structure of a conventional three-electrode, AC-type plasma display panel.
Figure 2:
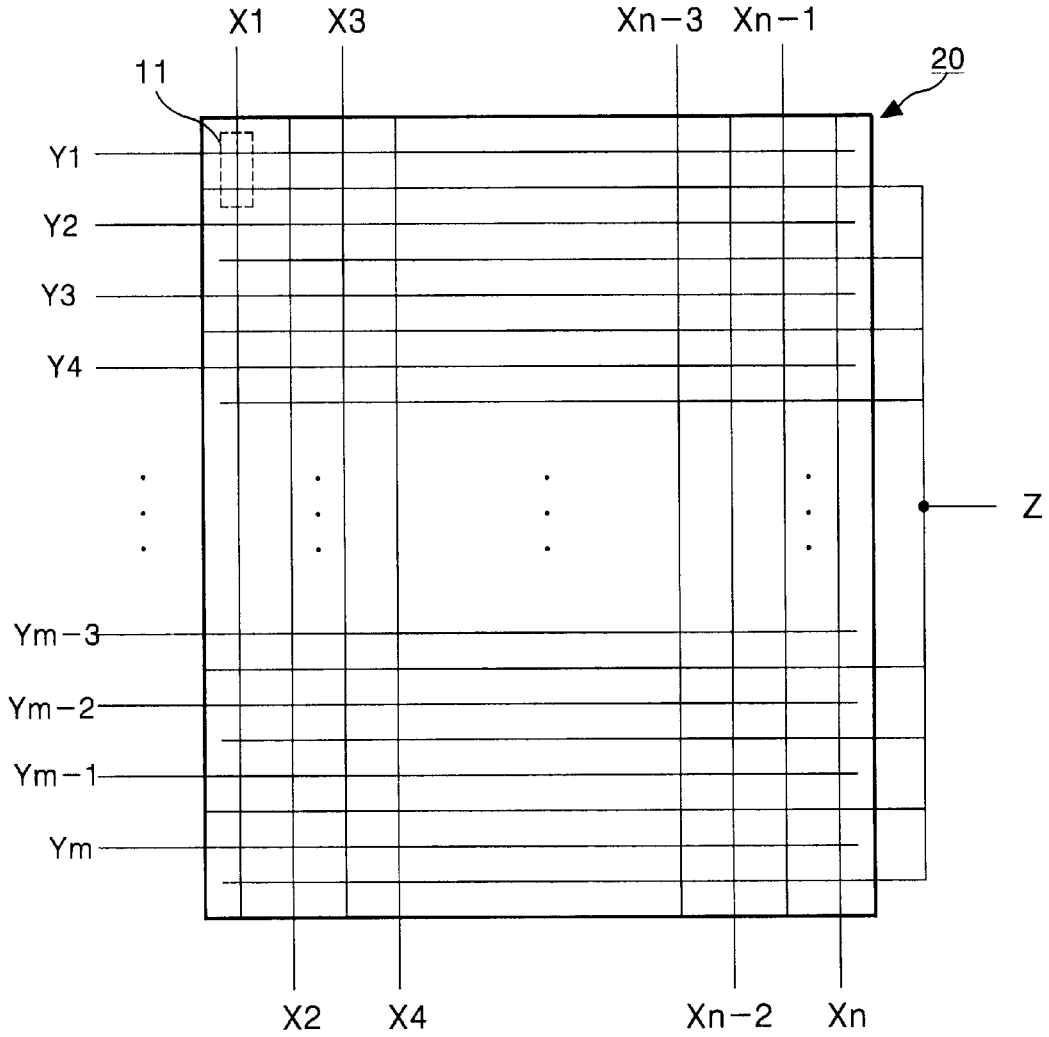
FIG.2 RELATED ART
FIG. 2 is a plan view showing an arrangement of the plasma display panel of FIG. 1.
Figure 3:
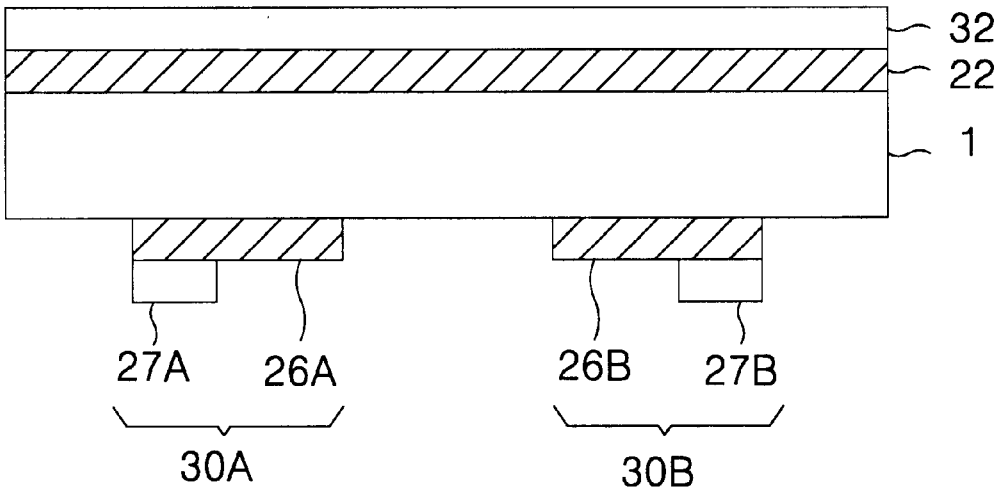
FIG. 3 is a schematic sectional view showing the structure of a front substrate in a plasma display panel according to an embodiment of the present invention.

Referring to FIG. 3, there is shown a plasma display panel(PDP) according to an embodiment of the present invention that includes a transparent conductive film 22 for a shielding of an electromagnetic wave formed on the front side of a front substrate 1, and a transparent electrode pair 26A and 26B formed on the rear side of the front substrate 1. The transparent conductive film 22 is connected to a ground voltage source to shield an electromagnetic wave incident thereto via the front substrate. A color filter 32 is entirely formed on the transparent conductive film 22 for a shielding of an electromagnetic wave. Any one of the transparent electrode pair 26A and 26B is used as a scanning/sustaining electrode to which a scanning pulse and a sustaining pulse ace applied sequentially, whereas the other of them is used as a common sustaining electrode. Metal electrodes 27A and 27B are formed on the transparent electrode pair 26A and 26B, respectively.

Figure 4A:
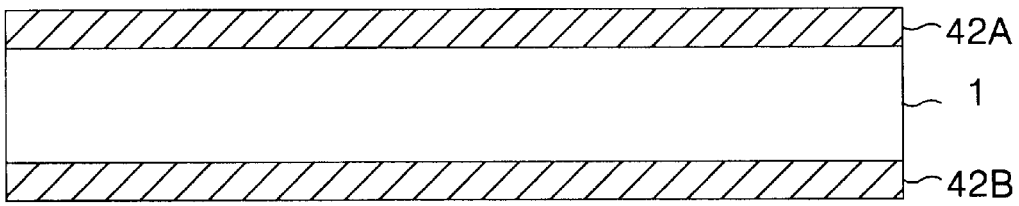
FIGS. 4A to 4C are sectional views illustrating a process of fabricating the front substrate in the plasma display panel according to an embodiment of the present invention.
Figure 4B:
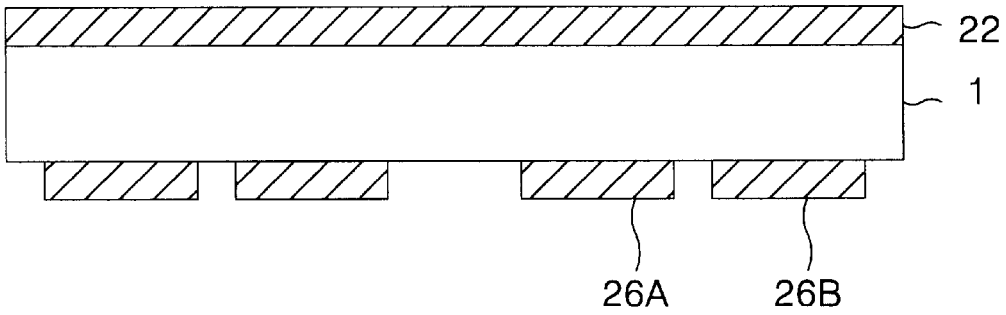
Figure 4C:
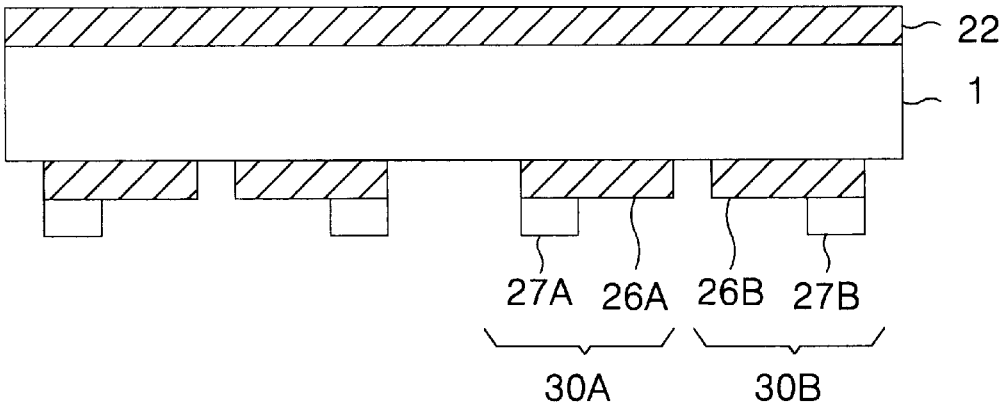

FIG. 4A to 4C illustrates a process of fabricating a front substrate in a PDP according to an embodiment of the present invention step by step. First, a transparent conductive solution is prepared. The transparent conductive solution is mixed with InO and SnO at a component ratio as indicated in the following Table:

TABLE 1

| Material | Component Ratio |
|---|---|
| InO | 18 |
| SnO | 2 |
| Solvent | 80 |

Herein, an alcohol is used as a solvent. The purpose of a mixture ratio of InO and SnO added, by 2 weight %, to the transparent conductive solution is to reduce a resistance. The transparent conductive solution may be mixed with an interfacial active agent for improving the mixture uniformity and a binding agent for increasing a binding force between particles, etc. On the front substrate 1, transparent conductive films 42A and 42B are formed by a dipping method, that is, by being precipitated in the transparent conductive material and thereafter being dried. As an alternative method for forming the transparent conductive films 42A and 42B on the front substrate 1, the transparent conductive material may be formed on any one surface of the front side and the rear side of the front substrate 1 or each surface of the front side and the rear side thereof using the spray method. Otherwise, the front substrate 1 may be coated with a transparent conductive solution using the roll coating method. In the above-mentioned transparent conductive film formation methods, the dipping method capable of simultaneously forming the transparent conductive films 42A and 42B on both the front side and the rear side of the front substrate 1 is preferable.

As shown in FIG. 4A, the transparent conductive films 42A and 42B are simultaneously formed on both the front side and the rear side of the front substrate 1. In the case where the transparent conductive films 42A and 42B formed in the above manner are made from a general transparent conductive material which do not have the sensitivity to light, they are fired at a desired temperature. Next, as shown in FIG. 4B, the transparent conductive film 42B formed on the rear side of the front substrate 1 is patterned using the photolithography to provide the transparent electrode pair 26A and 26B. As shown in FIG. 4C, the metal electrodes 27A and 27B are formed on the transparent electrode pair 26A and 26B. Finally, a dielectric layer and a protective film are sequentially deposited on the rear side of the front substrate 1 so as to cover the transparent electrode pair 26A and 26B and the metal electrode pair 27A and 27B, and the color filter 32 is formed on the transparent conductive film 22 for a shielding of an electromagnetic wave.

On the other hand, in the case where the transparent conductive solution is mixed with a photo-polymer to provide the sensitivity to light, a mask pattern is put on the transparent conductive film 42B formed on the rear side of the front substrate 1 to be exposed to a light and developed, and thereafter the transparent conductive film 42 is fired.

As described above, according to the present invention, the transparent conductive material is grown on the front side and the rear side of the front substrate using the dipping, spray or roll coating method, and the grown transparent conductive material is fired before the dielectric layer was formed. Accordingly, the color display panel according to the present invention does not need to form the transparent conductive film by a vacuum deposition technique causing a rise of a fabrication cost, and does not need to add an additional conductive mash to the color filter because the transparent conductive film formed on the front substrate shield an electromagnetic wave. Also, the color display device according to the present invention can prevent the transparent conductive film and the transparent electrode pair from being oxidized upon firing of the dielectric layer because the transparent conductive film for a shielding of an electromagnetic wave and the transparent electrode pair before the dielectric layer was formed. As a result, the color display device according to the present invention is capable of lowering a fabrication cost as well as preventing a resistance increase due to an oxidation of the transparent conductive film for a shielding of an electromagnetic wave and the transparent electrode pair to be suitable for forming the transparent electrodes and the transparent conductive films.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A process of fabricating a front substrate in a color display panel, comprising the steps of:

entirely forming a liquid-state transparent conductive material on both the front side and the rear side of the front substrate; and patterning any one of the transparent conductive material films formed on the front side and the rear side of the front substrate.

2. The process according to claim 1, further comprising the step of:

firing the liquid-state transparent conductive films after or before the patterning.

3. The process according to claim 1, wherein the liquid-state transparent conductive material is simultaneously formed on the front side and the rear side of the front substrate using a dipping method.

4. The process according to claim 1, wherein the liquid-state transparent conductive material is simultaneously formed on the front side and the rear side of the front substrate using a spray method.

5. The process according to claim 1, wherein the liquid-state transparent conductive material is simultaneously formed on the front side and the rear side of the front substrate using a roll coating method.

6. The process according to claim 1, wherein the color display panel is a plasma display panel.

7. The process according to claim 1, wherein the transparent conductive material is mixed with InO, SnO and a solvent at a desired component ratio.

8. The process according to claim 7, wherein the transparent conductive material is mixed with 18 weight % InO, 2 weight % SnO and 80 weight % solvent.

* * * * *